US007351016B1

(12) United States Patent
Nordloh

(10) Patent No.: US 7,351,016 B1
(45) Date of Patent: Apr. 1, 2008

(54) APPARATUS FOR SECURING AN EROSION CONTROL BLANKET TO THE GROUND

(76) Inventor: Thomas H. Nordloh, 4111 Taft Rd., Kenosha, WI (US) 53142

( * ) Notice: Subject to any disclaimer, the term of this patent is extended or adjusted under 35 U.S.C. 154(b) by 0 days.

(21) Appl. No.: 11/674,106

(22) Filed: Feb. 12, 2007

(51) Int. Cl.
*E02D 17/20* (2006.01)

(52) U.S. Cl. ..... 405/302.6; 405/302.7; 405/15

(58) Field of Classification Search ..... 405/302.6, 405/302.7, 302.4, 15–17
See application file for complete search history.

(56) References Cited

U.S. PATENT DOCUMENTS 6,592,295 B2 * 7/2003 McPhillips ..... 405/302.7
6,663,324 B2 * 12/2003 Nordloh ..... 405/302.6
7,188,447 B2 * 3/2007 Rose et al. ..... 47/32.2
2003/0072622 A1 * 4/2003 McPhillips ..... 405/302.7
2003/0198522 A1 * 10/2003 Nordloh ..... 405/302.7

* cited by examiner

*Primary Examiner*—Frederick L. Lagman
(74) *Attorney, Agent, or Firm*—Jansson Shupe & Munger Ltd.

(57) ABSTRACT

In a preferred embodiment an apparatus for securing an erosion control blanket to the ground, the erosion control blanket is placed on the ground by an erosion blanket installation device. The apparatus includes a support member secured to the erosion blanket installation device and a lever arm rotatably attached at a first end to the support member. The apparatus further includes a gun assembly rotatably attached to a second end of the lever arm, wherein the gun assembly includes a gun capable of fastening the erosion control blanket to the ground with fasteners and a wheel capable of rolling over the erosion control blanket.

18 Claims, 3 Drawing Sheets

APPARATUS FOR SECURING AN EROSION CONTROL BLANKET TO THE GROUND

FIELD OF THE INVENTION

This invention is related generally to the installation of erosion control blankets or erosion blankets and, more particularly, to an apparatus and method of use for securing erosion blankets to the ground.

BACKGROUND OF THE INVENTION

Erosion blankets are used throughout the world to stabilize soil before seed germinates and/or small plant plugs cover the ground. Erosion blankets are used for a variety of reasons, such as stabilizing large areas along highways, stabilizing areas around detention/retention ponds, establishing fine quality lawns for commercial and residential properties and restoring prairies. Erosion blankets are typically provided in rolls of 65 to 100 yard rolls, depending upon the type of blanket. The most widely used blankets are made of straw and wood fiber. Typically, erosion blankets of every type are installed by hand.

Erosion blankets are typically utilized to keep the soil and seed from eroding away during and after precipitation. In addition to preventing erosion, such blankets retain moisture in the soil under the blanket for a much longer period of time. The extended presence of moisture enables the seed to germinate much more quickly than without blanket cover.

In addition, erosion blankets retard weed growth when grass seed is planted in the late spring and early summer months. Due to the consistent shade that is provided by the erosion blanket the vast majority of noxious weed seed will not germinate.

In the landscaping industry, two alternative products are often used to encourage seed germination. These products are straw mulch and hydro mulch, both of which are typically mechanically blown or dropped onto the soil. However, bales of straw which are broken apart and spread on the soil as straw mulch can blow away which leads to mixed results. Hydro mulch, a paper component with seed and fertilizer mixed in slurry of water, helps the seed germinate but does not control erosion. Furthermore, hydro mulch is a poor medium to keep moisture in the soil during critical dry times of the growing season. While straw mulch and hydro mulch are less effective than erosion blankets, their use is popular due to their lower associated costs, especially the labor costs involved in installing the mulch on the soil.

Erosion blankets are typically installed after a site has been fine graded (soil prepared for seed) and seeded. The seed may be broadcast or installed using a mechanical seeder. For use with small plant plugs, the erosion blanket is installed and the plant plugs are manually planted into the blanket. In either use, after the erosion blanket has been laid on the ground, stakes must be manually driven through the blanket into the ground to keep the blanket in correct position. The stakes are typically six inches long and must be driven deep enough such that they are flush with the erosion blanket so that mowers do not strike them. The manual operations dealing with the installation of stakes significantly increase the cost of installing an erosion blanket and often lead landscapers to use the less labor-intensive products mentioned above for reasons involving both time and costs.

Machines have been developed which can overcome many of the difficulties of installing erosion blankets. For example, U.S. Pat. No. 6,663,324, the disclosure of which is hereby incorporated by reference, teaches an erosion blanket installation device which unrolls a erosion blanket and secures it to the ground via fasteners. In this device the guns for deploying the fasteners are fixedly mounted to the frame of the device and cannot move in order to facilitate securing the erosion blanket or in order to facilitate moving the device when not being used to install an erosion blanket.

OBJECTS OF THE INVENTION

It is an object of the invention to provide an apparatus for securing an erosion control blanket to the ground overcoming some of the problems and shortcomings of the prior art, including those referred to above.

Another object of the invention is to provide an apparatus for securing an erosion control blanket to the ground which can move independently of the erosion blanket installation device to which it is attached.

Another object of the invention is to provide an apparatus for securing an erosion control blanket to the ground which will assist in keeping the erosion blanket in place against the ground while the erosion blanket is secured by fasteners.

Another object of the invention is to provide an apparatus for securing an erosion control blanket to the ground that can move between a first position in which the apparatus follows the ground and a second position in which the apparatus is raised from the ground to facilitate movement from one location to another.

How these and other objects are accomplished will become apparent from the following descriptions and the drawings.

SUMMARY OF THE INVENTION

In a preferred embodiment an apparatus for securing an erosion control blanket to the ground, the erosion control blanket is placed on the ground by an erosion blanket installation device. The apparatus includes a support member secured to the erosion blanket installation device and a lever arm rotatably attached at a first end to the support member. The apparatus further includes a gun assembly rotatably attached to a second end of the lever arm, wherein the gun assembly includes a gun capable of fastening the erosion control blanket to the ground with fasteners and a wheel capable of rolling over the erosion control blanket.

Another embodiment of the invention is an improvement in an erosion blanket installation device, wherein the erosion blanket installation device includes a frame and erosion blanket installation device install an erosion control blanket on the ground. The improvement includes a lever arm rotatably attached at a first end to the frame and a gun assembly rotatably attached to a second end of the lever arm. The gun assembly includes a gun capable of fastening the erosion control blanket to the ground with fasteners and a wheel capable of rolling over the erosion control blanket.

Another embodiment of the invention is a method of securing an erosion control blanket to the ground. The method includes providing a roll of erosion control blanket and providing a erosion blanket installation device. The device includes at least one gun assembly pivotally mounted to the device and the assembly includes at least one wheel. The roll is then placed in the device which supports it in place and the device is propelled in the desired direction. As the device is propelled the roll is unwound so that the blanket covers the ground and the wheel of the gun assembly presses the blanket to the ground as roll unwinds. Finally the blanket is secured to the ground by piercing the blanket with fasteners from a gun of the gun assembly.

DETAILED DESCRIPTION OF THE PREFERRED EMBODIMENTS

Figure 1:
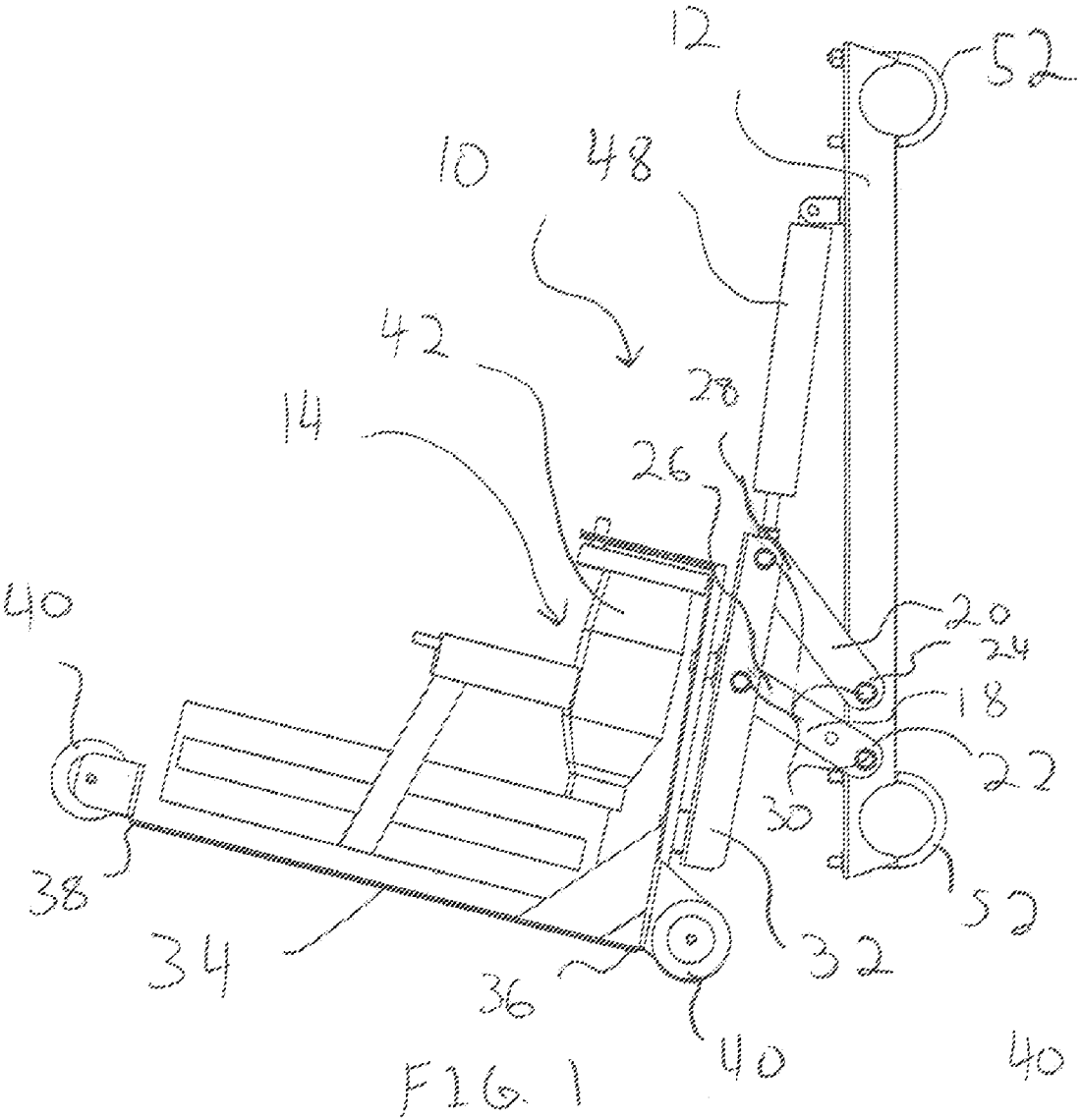
FIG. 1 is a side view of a preferred embodiment of an apparatus for securing an erosion control blanket to the ground in an raised position.

FIG. 1 illustrates a preferred embodiment of an apparatus 10 for securing an erosion control blanket to the ground. The apparatus 10 includes support member 12 pivotally interconnected with a gun assembly 14.

The gun assembly 14 is rotatably connected to the support member 12 by a four-point assembly 16. The four-point assembly 16 includes a first lever arm 18 and a second lever arm 20. Each lever arm 18, 20 includes first ends 22, 24 and second ends 26, 28. The first ends 22, 24 are rotatably attached to the support member 12 via pins 30. The seconds end 26, 28 are rotatably attached to the gun assembly 14 via pins 30 as well.

Figure 2:
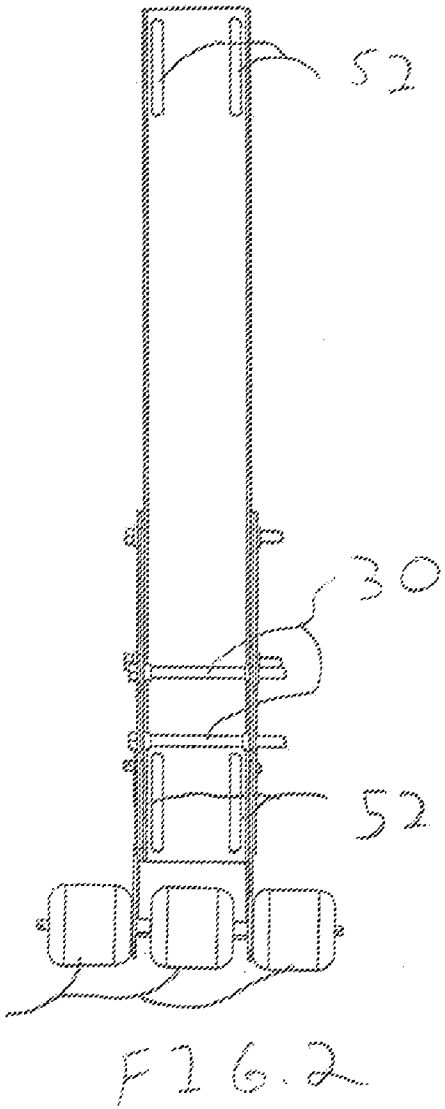
FIG. 2 is a view of the apparatus of FIG. 1. from one end.

The gun assembly 14 includes an upright support 32 interconnected to a platform 34. The platform 34 includes a proximal end 36 and a distal end 38. Wheels 40 are preferably mounted to the platform 34 at both the proximal 36 and distal ends 38. In this preferred embodiment and as seen in FIG. 2, the platform 24 includes three wheels 40 on the proximal end 36. The platform also includes one wheel 40 at the distal end 38. In this preferred embodiment, the wheels 40 are of a wide roller-type design. The wheels 40 serve to pass over the erosion blanket and hold it down when in operation.

Figure 4:
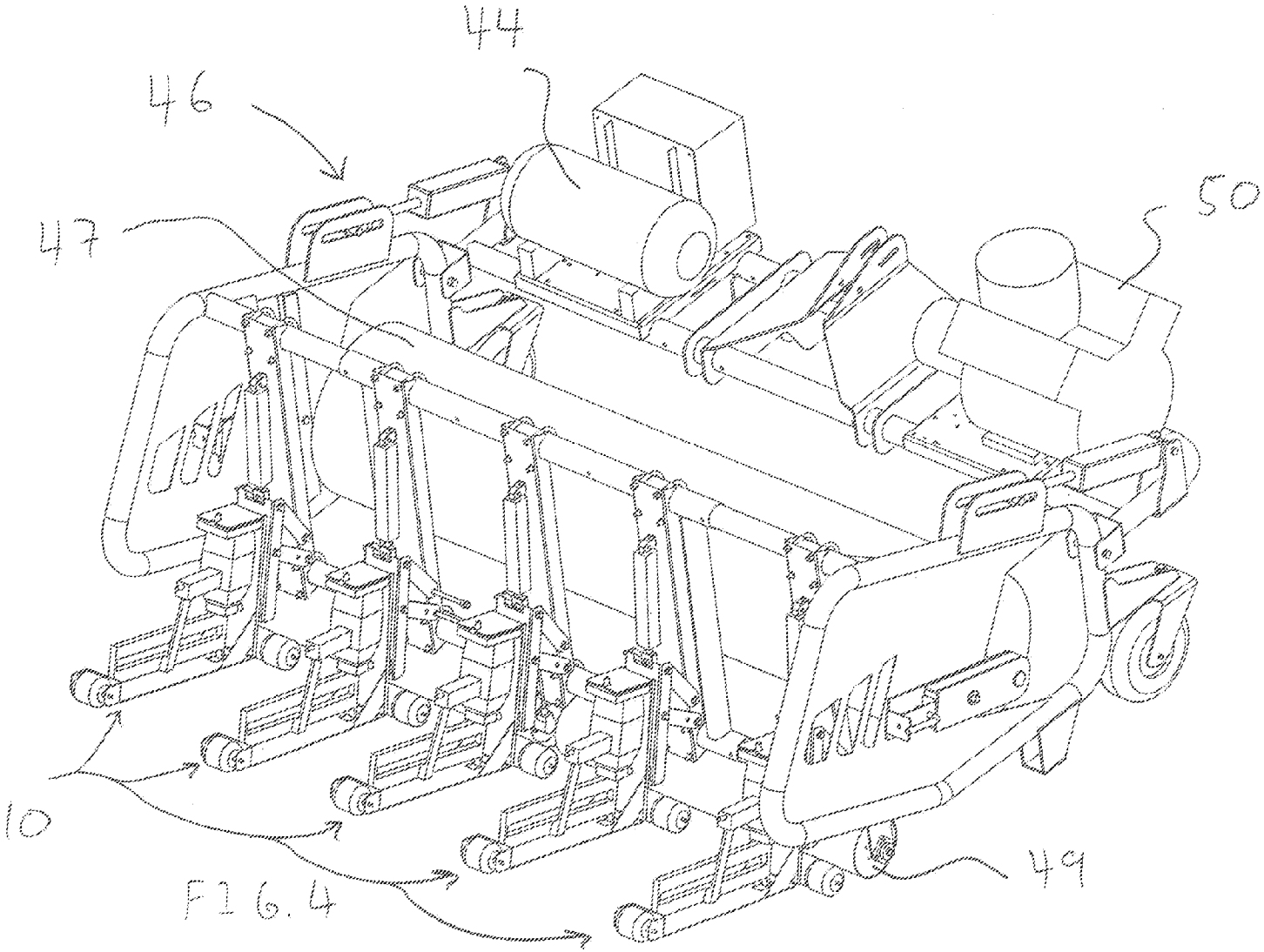
FIG. 4 is a perspective view of an erosion blanket installation device with five of the apparatus of FIG. 1 attached.

Finally, the gun assembly 14 includes a gun 42. The gun is of any known design and can be computer controlled and powered by compressed air from an air compressor 44 mounted on the erosion blanket installation device 46 as seen in FIG. 4. The gun 42 shoots fasteners (not shown) as known in the art and described in the previously incorporated reference.

Figure 3:
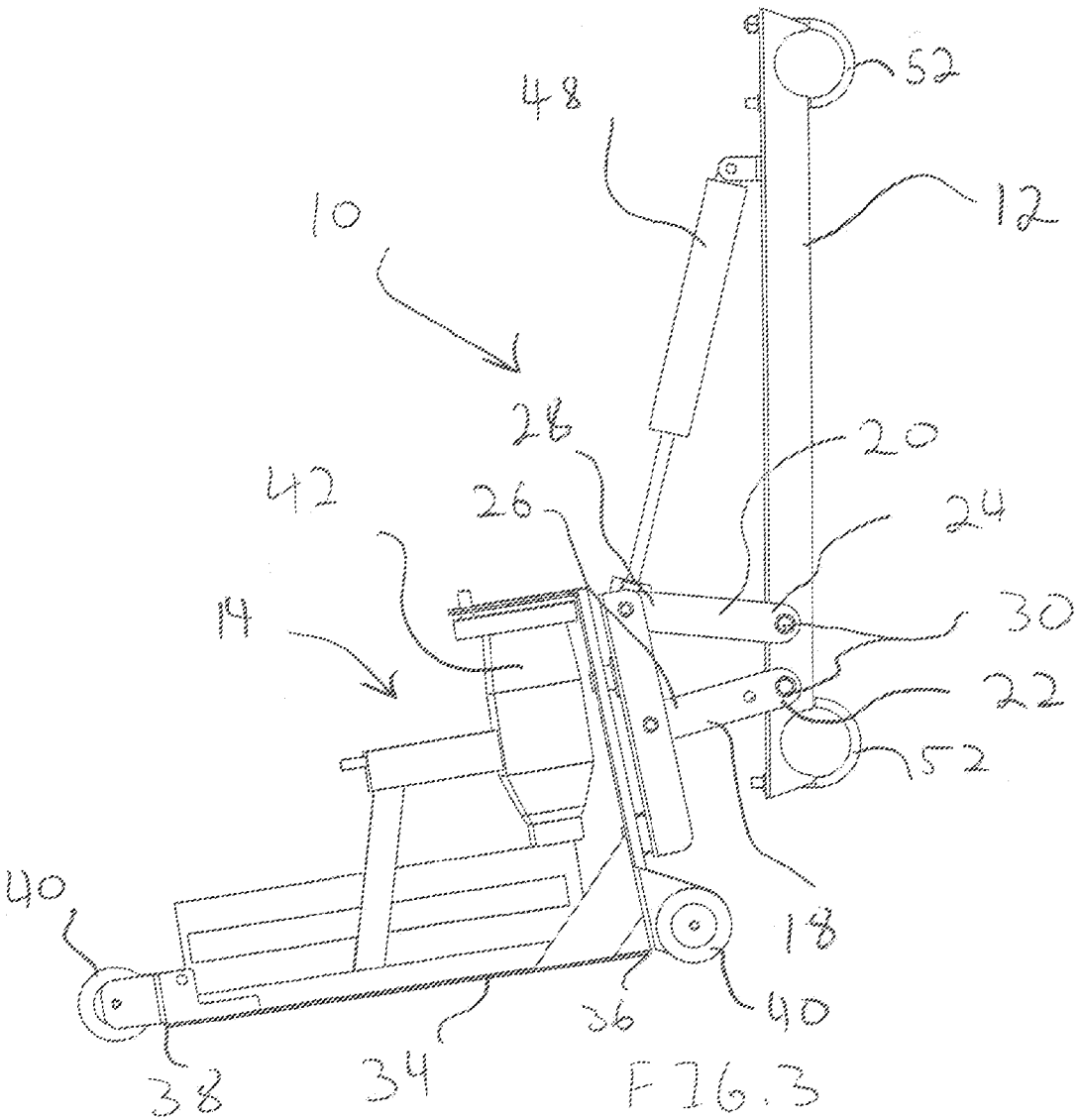
FIG. 3 is a side view of the apparatus of FIG. 1 is a lowered position.

The gun assembly 14 and support member 12 are further connected by a piston arm 48. The piston arm 48 is powered by a hydraulic motor 50 and operates to move the gun assembly 14 between a first or lowered position as seen in FIG. 1 and a second or raised position as seen in FIG. 3.

For use, the apparatus 10 is connected to a erosion blanket installation device 46 via rings 52 on the support member 12 as shown in FIG. 4. However, the support member 12 could be an integral part of the device 46 so no rings 52 for connection would be necessary. In this preferred embodiment a plurality of the apparatus 10 are attached to ensure proper fastening to the ground. Most preferably five of the apparatus 10 are used In operation, the device 46 with the apparatus 10 attached is taken to the location to be covered and a roll 47 of erosion blanket is placed into the device 46 were the roll 47 is supported in place. The piston arm 48 is then extended on each apparatus 10 and the gun assembly 14 is moved into the lowered position. As the device 46 is propelled the erosion blanket (not shown) is rolled out and passes under rear wheels 49 of the device.

The blanket then comes in contact with the wheels 40 mounted on the proximal end 36 of the platform 34 whereby the blanket is kept in contact with the ground. The gun 42 then shoots a fasteners partially through the blanket and into the ground whereby the blanket is fastened to the ground. As the device continues to move the blanket passes under the wheel 40 mounted to the distal end 38 of the platform. The wheels 40 of the apparatus 10 operate independently from the device thereby ensuring the most contact possible between the ground and the blanket. This is especially important in areas with uneven ground. This advantage is further increased by the fact the at the each apparatus 10 can operate independently from the others.

Once the desired amount of ground is covered, the piston arms 48 can be retracted into the raised or second position. In this position the gun assembly 14 is raised away from the ground to avoid damaged during the fast movement of transport.

While the principles of the invention have been shown and described in connection with specific embodiments, it is to be understood that such embodiments are by way of example and are not limiting.

I claim:

1. An apparatus for securing an erosion control blanket to the ground, the erosion control blanket being placed on the ground by an erosion blanket installation device, the apparatus comprising:

a support member secured to the erosion blanket installation device;

a lever arm rotatably attached at a first end to the support member;

a gun assembly rotatably attached to a second end of the lever arm, wherein the gun assembly includes a gun capable of fastening the erosion control blanket to the ground with fasteners and a wheel capable of rolling over the erosion control blanket.

2. The apparatus of claim 1, wherein the lever arm comprises a first lever arm, the apparatus further comprising a second lever arm rotatably attached at a first end to the support member and rotatably attached at a second end to the gun assembly.

3. The apparatus of claim 2, wherein the gun assembly includes a platform having proximal and distal ends and wherein the wheel comprises a first wheel mounted at the proximal end of the platform, the apparatus further comprising a second wheel mounted at the distal end of the platform.

4. The apparatus of claim 3, further comprising a piston arm connecting the gun assembly to the support member, whereby the piston arm is capable of pivoting the gun apparatus between a first position wherein the first and second wheels are in contact with the ground and a second position wherein the first and second wheels are lifted from the ground.

5. The apparatus of claim 3, further comprising third and forth wheels mounted at the proximal end of the platform.

6. The apparatus of claim 4, further comprising a hydraulic motor connected to the piston arm for hydraulically moving the gun assembly between the first and second positions.

7. An improvement in an erosion blanket installation device, wherein the erosion blanket installation device includes a frame and erosion blanket installation device install an erosion control blanket on the ground, the improvement comprising:

a lever arm rotatably attached at a first end to the frame;

a gun assembly rotatably attached to a second end of the lever arm, wherein the gun assembly includes a gun capable of fastening the erosion control blanket to the ground with fasteners and a wheel capable of rolling over the erosion control blanket.

8. The improvement of claim 7, wherein the lever arm comprises a first lever arm, the improvement further comprising a second lever arm rotatably attached at a first end to the frame and rotatably attached at a second end to the gun assembly.

9. The improvement of claim 8, wherein the gun assembly includes a platform having proximal and distal ends and wherein the wheel comprises a first wheel mounted at the proximal end of the platform, the apparatus further comprising a second wheel mounted at the distal end of the platform.

10. The improvement of claim 9, further comprising a piston arm connecting the gun assembly to the frame, whereby the piston arm is capable of pivoting the gun apparatus between a first position wherein the first and second wheels are in contact with the ground and a second position wherein the first and second wheels are lifted from the ground.

11. The improvement of claim 9, further comprising third and forth wheels mounted at the proximal end of the platform.

12. The improvement of claim 10, further comprising a hydraulic motor connected to the piston arm for hydraulically moving the gun assembly between the first and second positions.

13. The improvement of claim 12, wherein the first and second lever arms, the gun platform and the piston arm comprise a securing assembly, further comprising a plurality of the securing assemblies connected to the frame.

14. The improvement of claim 13 wherein five securing assemblies are connected to the frame.

15. A method of securing an erosion control blanket to the ground, the method comprising:

providing a roll of erosion control blanket;

providing a erosion blanket installation device, the device including at least one gun assembly pivotally mounted to the device and the assembly including at least one wheel;

supporting the roll in the device;

propelling the device in a direction;

unwinding the roll so that the blanket covers the ground, the wheel of the gun assembly pressing the blanket to the ground as roll unwinds; and securing the blanket to the ground by piercing the blanket with fasteners from a gun of the gun assembly.

16. The method of claim 15 wherein the gun assembly is capable of moving between a first position wherein the wheel is in position to press the blanket and a second position wherein the wheel is lifted above the first position for facilitating movement of the device, the method further comprising positioning the gun assembly in the first position prior to unwinding the roll.

17. The method of claim 16 wherein the gun assembly is hydraulically moved between the first and second position.

18. The method of claim 15 wherein the fasteners secure the blanket to the ground by an air compressor included in the device.

* * * * *